US008185039B2

(12) United States Patent
Kato et al.

(10) Patent No.: US 8,185,039 B2
(45) Date of Patent: May 22, 2012

(54) SHEET PROCESSING APPARATUS AND IMAGE FORMING APPARATUS

(75) Inventors: Hitoshi Kato, Toride (JP); Tsuyoshi Moriyama, Toride (JP); Naoki Ishikawa, Kashiwa (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 878 days.

(21) Appl. No.: 12/122,998

(22) Filed: May 19, 2008

(65) Prior Publication Data

US 2008/0290576 A1 Nov. 27, 2008

(30) Foreign Application Priority Data

May 23, 2007 (JP) ..... 2007-136435
Apr. 25, 2008 (JP) ..... 2008-114822

(51) Int. Cl.
*G03G 15/00* (2006.01)
*B65H 37/04* (2006.01)

(52) U.S. Cl. ..... 399/410; 399/407

(58) Field of Classification Search ..... 399/410
See application file for complete search history.

(56) References Cited

U.S. PATENT DOCUMENTS

| | | | | |
|---|---|---|---|---|
| 5,020,785 | A | 6/1991 | Kosaka et al. | 270/53 |
| 7,185,883 | B2 | 3/2007 | Kato et al. | 270/58.11 |
| 7,360,958 | B2 * | 4/2008 | Awano | 400/621 |
| 7,389,084 | B2 | 6/2008 | Watanabe et al. | 399/391 |
| 2007/0045926 | A1 | 3/2007 | Fukatsu et al. | 270/58.07 |

FOREIGN PATENT DOCUMENTS

| | | | |
|---|---|---|---|
| JP | 03-152572 | A | 6/1991 |
| JP | 03152572 | A * | 6/1991 |
| JP | 08073108 | A * | 3/1996 |
| JP | 2001-97623 | | 4/2001 |
| JP | 2001-220055 | | 8/2001 |
| JP | 2001220055 | A * | 8/2001 |
| JP | 2006137538 | A * | 6/2006 |

OTHER PUBLICATIONS

Machine Translation of JP 2001220055 A (Hayashi et al.), JPO, Mar. 17, 2011.*

Notification of Second Office Action, dated Aug. 19, 2011, issued by the State Intellectual Property Office of P.R. China, in Chinese Application No. 200810098311.0.

* cited by examiner

*Primary Examiner* — Judy Nguyen
*Assistant Examiner* — Nguyen Q Ha
(74) *Attorney, Agent, or Firm* — Fitzpatrick, Cella, Harper & Scinto

(57) ABSTRACT

A sheet processing apparatus includes a stack tray, a stapler, a stapler moving device, and an aligning member. When a stapling process is performed at least two staple positions of the sheet bundle stacked on the stack tray using the stapler, the stapler is moved to the next staple position by relative movement in which the stapler and the sheet bundle are moved in the opposite directions by the stapler moving device and the aligning member respectively. When the number of sheets in the sheet bundle or a weight of the sheet bundle is lower than a predetermined value, a moving speed of the sheet bundle is set faster than a moving speed of the sheet bundle at which the number of sheets in the sheet bundle is not lower than the predetermined value or the weight of the sheet bundle is not lower than the predetermined value.

12 Claims, 16 Drawing Sheets

SHEET PROCESSING APPARATUS AND IMAGE FORMING APPARATUS

BACKGROUND OF THE INVENTION

1. Field of the Invention

The present invention relates to a sheet processing apparatus which performs stapling of a sheet bundle and an image forming apparatus provided therewith.

2. Description of the Related Art

Conventionally, there is the sheet processing apparatus in the image forming apparatus such as a copying machine, a printing machine, and a laser beam printer. In the sheet processing apparatus, for example, the stapling is performed after sheets on which images are already formed are sequentially taken in from an image forming apparatus body. In the sheet processing apparatus, it is necessary that a post-process such as stapling be performed between each sheet bundle job, e.g., at a time interval between the final sheet of the preceding job delivered from the image forming apparatus and the first sheet of the subsequent job. However, when plural positions of the sheet bundle points are stapled, a long time is required to both move a stapler and perform stapling, thereby lengthening a stapling process time. Therefore, it is necessary to lengthen the sheet bundle (job) interval, thereby lowering productivity of the image forming apparatus.

In the case where the distance between sheets delivered from the image forming apparatus is widened at the sheet bundle interval, the productivity is significantly decreased when there is a small number of sheets in the bundle. For example, in the image forming apparatus having the productivity of 100 sheets per minute, the decreases in productivity of two sheets in a sheet bundle and 100 sheets in a sheet bundle when the sheet bundle interval is widened by 0.2 s in the stapling process. The productivity CPM is determined by the following equation. As used herein, the productivity shall mean the number of sheets which can be printed per one minute.

$$CPM=60/((60/cpm)\times a+b)/a)$$

cpm(copy per minute): image forming apparatus productivity (the number of copies per minute)

a: the number of sheets in bundle b: stapling process time

In the equation, a stapling process time is added to a total printing time of the image forming apparatus, and the additional value is divided by the number of sheets in the bundle to determine average productivity of the bundle.

As a result of the computation with the equation, the productivity becomes 85.7 cpm in the case of two sheets, and the productivity becomes 99.7 cpm in the case of 100 sheets. The productivity is not significantly influenced by stoppage of the image forming apparatus in the case of 100 sheets while the productivity is largely decreased in the case of two sheets.

Therefore, for example, U.S. Pat. No. 5,020,785 proposes a configuration in which, when the sheet bundle is moved to the next staple position of a stapler, the sheet bundle is relatively moved in an opposite direction to a stapler moving direction along with the movement of the stapler, thereby shortening a time in which the sheet bundle is moved to the next staple position.

However, a weight of the sheet bundle depends on the number of sheets to be stapled and a kind of the sheet. That is, the weight of the sheet bundle is increased as the number of sheets in the bundle is increased or as the size or grammage of the sheets is increased. In a motor for moving the sheet bundle, a rotating speed becomes slower as the weight of the sheet bundle is increased. Therefore, when the sheet bundle is moved at a constant speed irrespective of the number of sheets in the sheet bundle or the kind of the sheet, a motor having the large output is required, which results in upsizing of the apparatus or increasing the cost.

SUMMARY OF THE INVENTION

The present invention provides a sheet processing apparatus in which the productivity is improved without enlargement of the apparatus or cost increase when the plural points of the sheet bundle are stapled and an image forming apparatus provided with the sheet processing apparatus.

In accordance with a first aspect of the invention, a sheet processing apparatus includes a sheet stacking portion on which a sheet bundle is stacked; a staple unit which staples the sheet bundle stacked on the sheet stacking portion; and a sheet bundle moving member which moves the sheet bundle, wherein, when a stapling process is performed at plural staple positions of the sheet bundle stacked on the sheet stacking portion, a moving speed of the sheet bundle is set faster as a number of sheets in the sheet bundle moved by the sheet bundle moving member is decreased, or as a weight of the sheet bundle moved by the sheet bundle moving member is decreased.

In accordance with a second aspect of the invention, an image forming apparatus includes an image forming portion which forms an image on a sheet; and a sheet processing apparatus according to the first aspect of the invention which processes the sheet on which the image is formed.

Accordingly, when plural points of the sheet bundle are stapled, the stapler is located at the next staple position by the relative movement in which the stapler and the sheet bundle are moved in the opposite directions, which allows the stapling process time to be shortened. The moving speed of the sheet bundle is changed according to the number of sheets in the sheet bundle or the weight of the sheet bundle, so that the stapling process time can be shortened in the small number of sheets in which the short process time is required.

Further features of the present invention will become apparent from the following description of exemplary embodiments with reference to the attached drawings.

DESCRIPTION OF THE EMBODIMENTS

An image forming apparatus including a sheet processing apparatus according to an exemplary embodiment of the invention will be described with reference to the drawings.

[Image Forming Apparatus]

Figure 2:
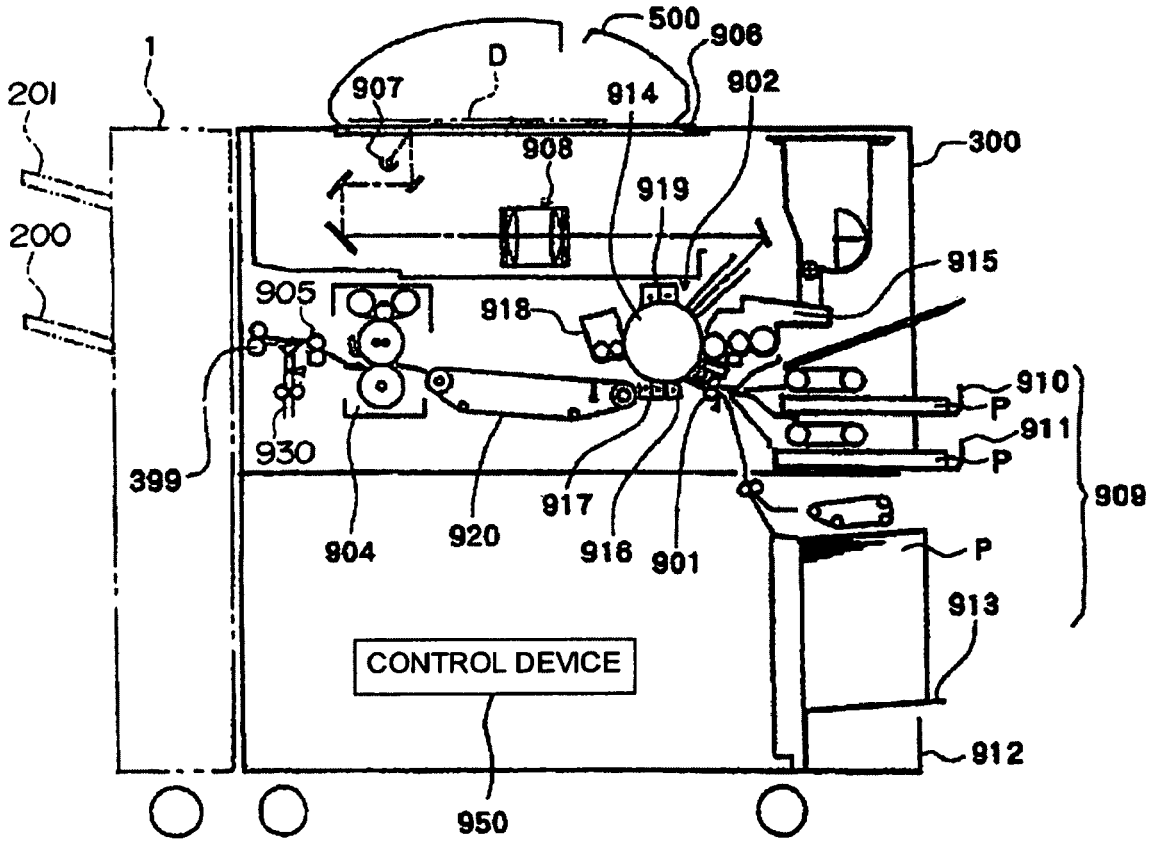
FIG. 2 is a schematic view illustrating an overall configuration of an image forming apparatus.

An overall configuration of the image forming apparatus will first be described. FIG. 2 illustrates an example of an image forming apparatus body (copying machine body) which is of a sheet output device including the sheet processing apparatus of the embodiment. A sheet processing apparatus 1 is designed to be able to be used with a part of the image forming apparatus into a main body of the image forming apparatus such as a printer, a copying machine, a facsimile, and a multi function peripheral. Accordingly, the sheet processing apparatus 1 of the embodiment is not always incorporated into the printer body.

An image forming apparatus body (copying machine body) 300 includes a platen glass 906 which is of an original placing platen, a light source 907, a lens system 908, a feeding portion 909, an image forming portion 902, and an automatic original feeder 500 which feeds an original to the platen glass 906. The image forming apparatus body 300 also includes the sheet processing apparatus 1. The sheet in which an image is already formed is discharged from the copying machine body and stacked on the sheet processing apparatus 1.

The feeding portion 909 includes cassettes 910 and 911 and a deck 913. Recording sheets P are accommodated in the cassettes 910 and 911 which are detachable from the image forming apparatus body 300. The deck 913 is disposed in a pedestal 912. The image forming portion 902 includes a cylindrical photosensitive drum 914, a development device 915, a transfer charger 916, a separation charger 917, a cleaner 918, and a primary charger 919. The development device 915, the transfer charger 916, the separation charger 917, the cleaner 918, and the primary charger 919 are provided around the photosensitive drum 914. A conveying belt 920, a fixing device 904, and a conveying roller pair 905 are provided on a downstream side in a sheet conveying direction of the image forming portion 902 (hereinafter simply referred to as "downstream side").

An operation of the image forming apparatus body 300 will be described. When a control device 950 provided on the side of the image forming apparatus body 300 outputs a feed signal, the sheet P is fed from the cassettes 910 and 911 or the deck 913. On the other hand, an original D placed on the platen glass 906 is illuminated with light emitted from the light source 907, the light is reflected from the original D, and the photosensitive drum 914 is irradiated with the light through the lens system 908. In the photosensitive drum 914 previously charged with the primary charger 919, an electrostatic latent image is formed by the irradiation, and the electrostatic latent image is developed to form a toner image by the development device 915.

The sheet P is fed from feeding portion 909, skew of the sheet P is corrected by the registration roller 901, and the sheet P is delivered to the image forming portion 902 at the right time. In the image forming portion 902, the toner image on the photosensitive drum 914 is transferred to the delivered sheet P by the transfer charger 916, and the sheet P to which the toner image is transferred is charged into an opposite polarity to the transfer charger 916 by the separation charger 917, thereby separating the sheet P from the photosensitive drum 914.

The conveying belt 920 conveys the separated sheet P to the fixing device 904 and the fixing device 904 is permanently fixes the transfer image to the sheet P. The sheet P to which the image is fixed is discharged from the image forming apparatus body 300 by a discharge roller pair 399 in a straight discharge mode or an inversion discharge mode. In the straight discharge mode, an image surface is orientated upward. In the inversion discharge mode, the sheet P is conveyed to a sheet inversion passage 930 after the image is fixed, the sheet is inverted to orientate the image surface downward.

Thus, the feeding portion 909 feeds the sheet P, the image is formed on sheet P, and the sheet P is discharged to the sheet processing apparatus 1.

[Sheet Processing Apparatus]

The sheet processing apparatus 1 will now be described. The sheet processing apparatus of the exemplary embodiment is formed as a finisher that performs a stapling process in each sheet bundle or an alignment process.

Figure 1:
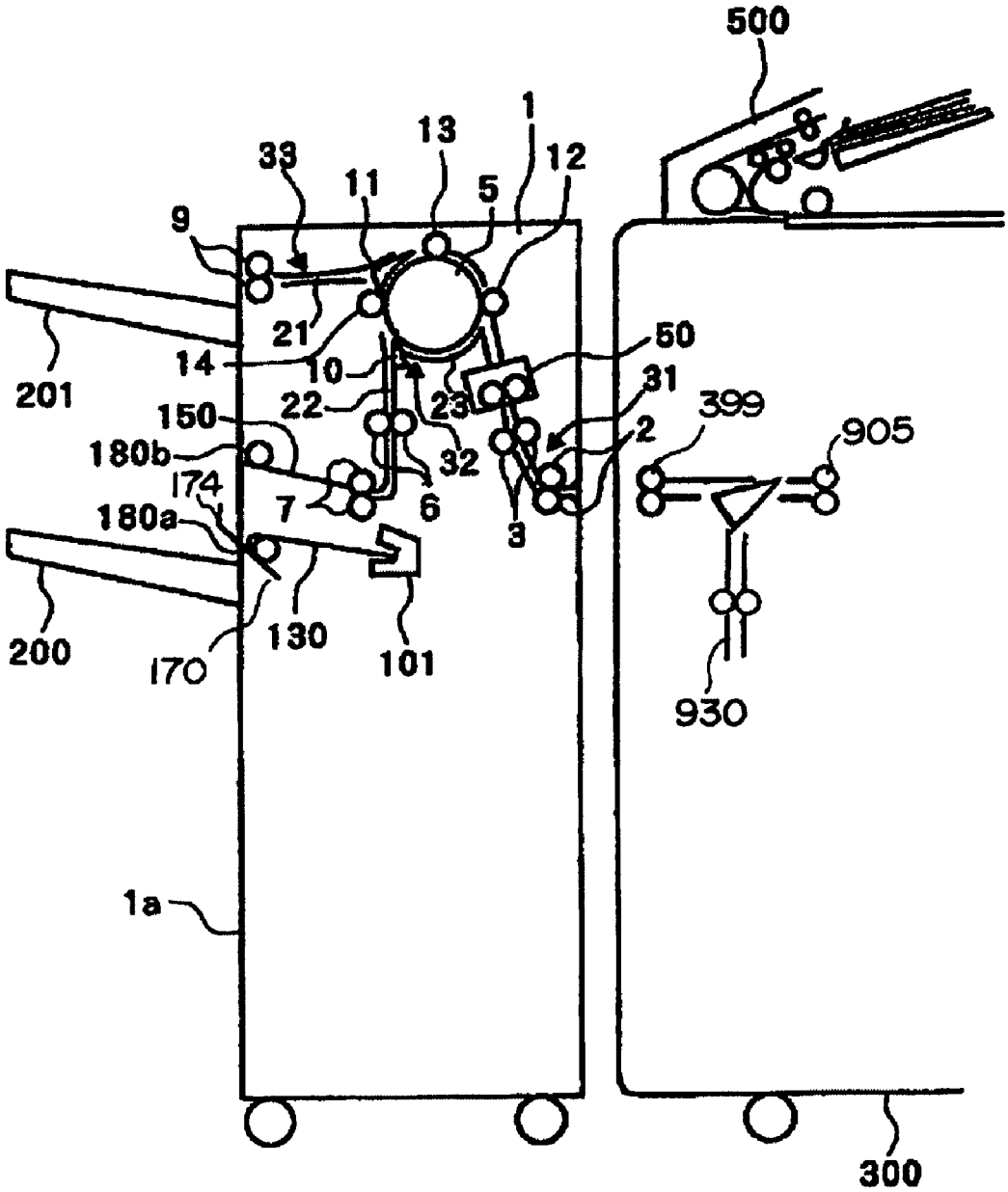
FIG. 1 is a front view illustrating an overall configuration of a sheet processing apparatus.

In FIG. 1, the discharge roller pair 399 delivers the sheet from the image forming apparatus body 300 to the sheet processing apparatus 1, and an inlet roller 2 and a conveying roller 3 conveys the sheet. Then, the sheet is detected by a sheet detection sensor 31, and a punch unit 50 selectively performs hole making process to a neighborhood of a rear end of the sheet, and the sheet is conveyed by a buffer roller (reservoir member) 5 and press-down rollers 12, 13, and 14 which press down the sheet.

Switch flappers 10 and 11 are provided around the buffer roller 5. The switch flapper 11 switches between the non-sort passage 21 and the sort passage 22. The switch flapper 10 switches between the sort passage 22 and the buffer passage 23 which temporarily accumulates the sheet in the periphery of the buffer roller 5. In order to buy time for processing the preceding sheet bundle on a processing tray 130, several sheets constituting the subsequent sheet bundle initially stand by in the buffer passage 23, and the standby sheets are discharged onto the processing tray 130 after the preceding sheet bundle is discharged from the processing tray 130. A discharge roller 9 is provided in the non-sort passage 21, and the discharge roller 9 discharges the sheet to a sample tray 201.

A conveying roller 6, a processing tray 130 (sheet stacking portion), and a discharge roller 7 are provided in the sort passage 22. The sheet is temporarily stacked on and aligned by the processing tray 130. The discharge roller 7 discharges the sheet to the processing tray 130. A stapler 101 (staple unit), a front-end abutment member 174, and a swing guide 150 are also provided in the sort passage 22. The stapler 101 staples the sheets on the processing tray 130. The front-end abutment member 174 causes the sheet to abut on the front end of the sheet discharged to the processing tray 130. The swing guide 150 can be swung to open and close the processing tray 130 toward the outside of the apparatus.

A bundle discharge roller pair 180 includes a bundle discharge lower roller 180*a* disposed in the processing tray 130 and a bundle discharge upper roller 180*b* supported by the swing guide 150. When the swing guide 150 is in the closed state, the bundle discharge lower roller 180*a* and the bundle discharge upper roller 180*b* convey the sheet bundle on the processing tray 130 while nipping the sheet bundle and discharge the sheet bundle onto the stack tray 200 which is of a sheet stacking portion on which the sheet bundle is stacked.

(Processing Tray Unit)

Then, a processing tray unit 129 will be described with reference to FIG. 3.

The processing tray unit 129 is provided between the conveying portion that conveys the sheet from the image forming apparatus body 300 and the stack tray 200 that receives the sheet bundle processed by the processing tray 130 and accommodates the sheet bundle.

The processing tray unit 129 includes the processing tray 130, a rear-end stopper 131, an aligning portion 140, the swing guide 150, retractable paddle 160, a rising tray 170, and the bundle discharge roller pair 180.

The processing tray 130 is an inclined tray in which the downstream side (left side of FIG. 3) is located above while an upstream side in the sheet conveying direction (hereinafter simply referred to as "upstream side", right side in FIG. 3) is located below, and a rear-end stopper 131 is fitted in an end portion of the lower portion. The sheet P discharged from the discharge roller 7 slides on the processing tray 130 by a dead weight and action of the paddle 160 until the rear end of the sheet P abuts on the rear-end stopper 131.

The bundle discharge lower roller 180*a* is provided in the upper end portion of the processing tray 130, and the bundle discharge upper roller 180*b* is provided in the swing guide 150 while abutting on the swing guide 150. The bundle discharge lower roller 180*a* and the bundle discharge upper roller 180*b* can be rotated normally and reversely by drive of a motor M180.

(Rear-End Stopper)

The rear end of the sheet P stacked on the processing tray 130 abuts on the rear-end stopper 131, and the processing tray 130 supports the sheet P. When the stapler 101 performs the binding process to the sheets stacked on the processing tray 130, the stapler 101 is moved in a direction orthogonal to the sheet discharge direction. Therefore, the rear-end stopper 131 can be turned so as not interfere with the movement of the stapler 101.

Figure 4:
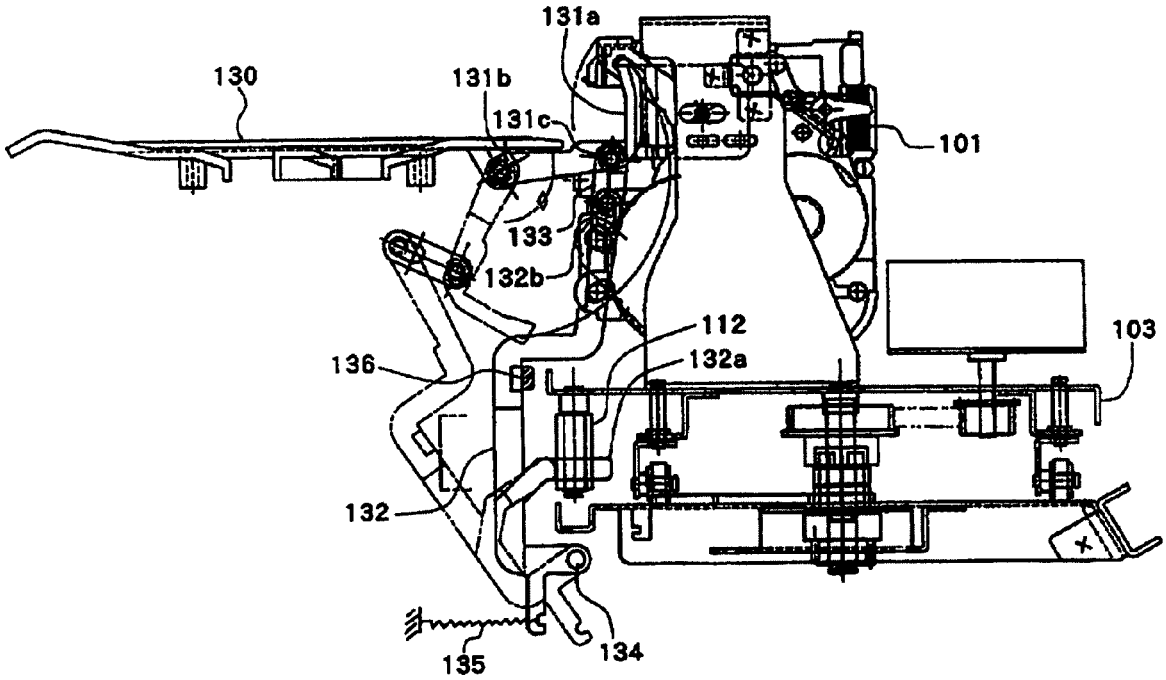
FIG. 4 is a side view illustrating a stapler and a processing tray unit.

Specifically, as illustrated in FIG. 4, the rear-end stopper 131 has a perpendicular surface with respect to the stack surface of the processing tray 130. The rear-end stopper 131 includes a support surface 131*a*, a pin 131*b*, and a pin 131*c*. The support surface 131*a* supports the rear end of the sheet. The pin 131*b* is swung while fitted in a round hole made in the processing tray 130. The pin 131*c* is fitted in a link. The link includes a main link 132 and a coupling link 133. The main link 132 has a cam surface 132*a*, a fall-down roller 112 assembled in the stapler moving stage 103 abuts on and presses the cam surface 132*a*. The coupling link 133 couples a pin 132*b* provided at an upper end of the main link 132 and a pin 131*c* of the rear-end stopper 131.

The main link 132 is swung about a shaft 134 fixed to a frame (not illustrated). A tension spring 135 is provided at a lower end of the main link 132 to bias the main link 132 clockwise. Because the main link 132 is positioned by a striking plate 136, usually the rear-end stopper 131 is maintained in an attitude perpendicular to the processing tray 130.

When the stapler moving stage 103 is moved, the fall-down roller 112 provided in the moving stage falls down the cam surface of the main link 132 coupled to the rear-end stopper 131 to interfere with the stapler 101. Therefore, the rear-end stopper 131 is pulled by the coupling link 133, and the rear-end stopper 131 is turned to a position where the rear-end stopper 131 does not interfere with the stapler 101. The plural fall-down rollers 112 (three rollers in the embodiment) are provided such that the rear-end stopper 131 is maintained at the retract position.

(Aligning Portion)

Figure 5:
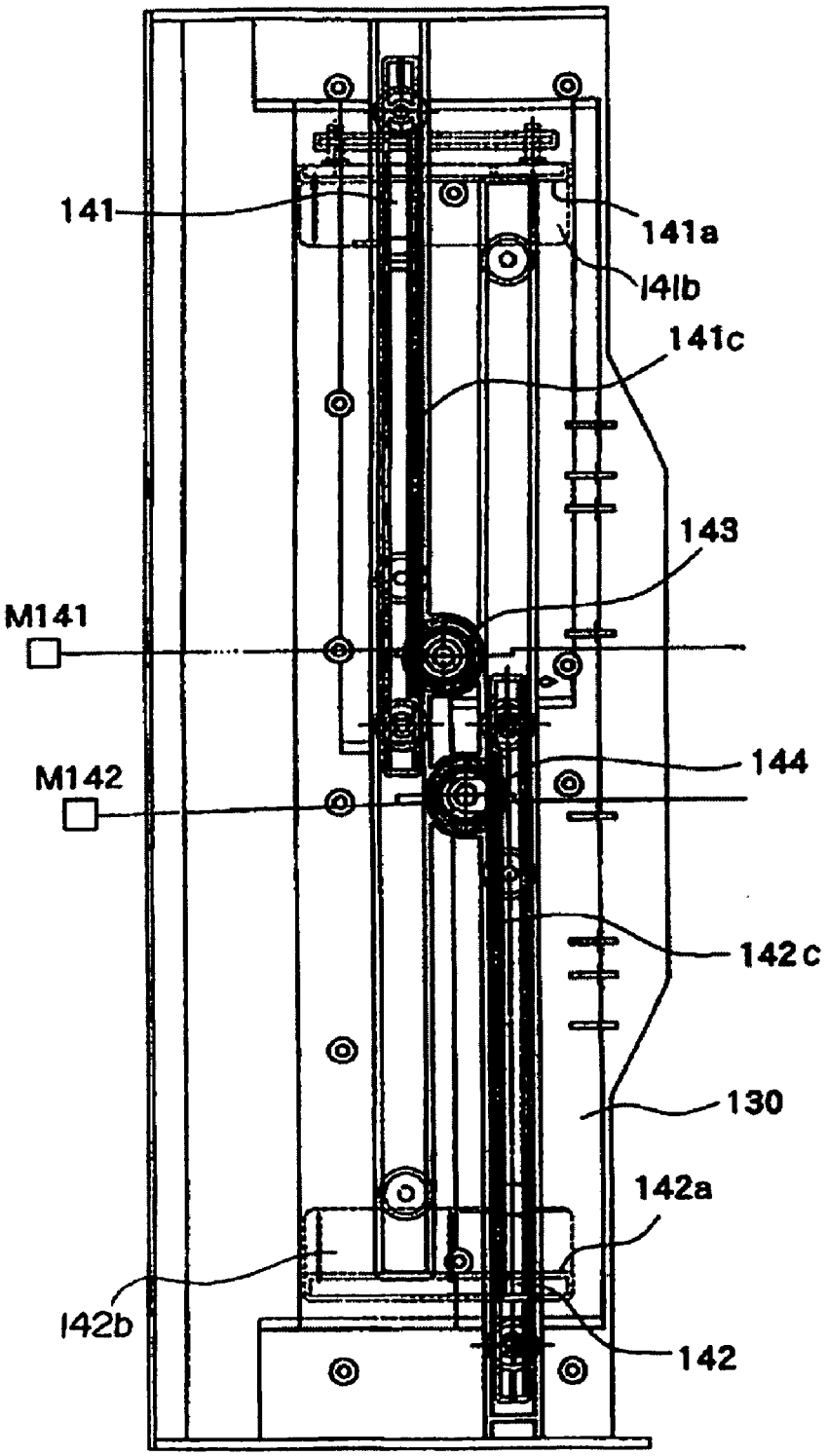
FIG. 5 is a plan view illustrating a processing tray and an alignment wall moving mechanism.

The aligning portion (alignment wall) 140 will now be described with reference to FIGS. 3 and 5. FIG. 5 illustrates the aligning portion 140 when viewed in the direction of arrow c of FIG. 3.

Aligning members 141 and 142 which are of the aligning portion 140 are configured to be able to be independently moved in a front-back direction. The front-side aligning member 141 and the rear-side aligning member 142 are vertically provided on the processing tray 130. The aligning members 141 and 142 include alignment surfaces 141*a* and 142*a*, support surfaces 141*b* and 142*b*, and rack gear portions 141*c* and 142*c* respectively. The alignment surfaces 141*a* and 142*a* press the side-end face of the sheet P, and the aligning members 141 and 142 are folded at the right angle from alignment surfaces 141*a* and 142*a*. The support surfaces 141*b* and 142*b* support the lower surface of the sheet P. The rack gear portions 141*c* and 142*c* are extended in the front-back direction in parallel with the processing tray 130, and rack gears are provided in the rack gear portions 141*c* and 142*c*. The two aligning members are supported by guides that are opened and extended in the front-back direction of the processing tray 130, and the aligning members are assembled such that the alignment surfaces of the aligning members are projected from the upper surface of the processing tray 130 while the gear portions of the aligning members are projected from the lower surface of the processing tray 130.

The rack gear portions 141*c* and 142*c* are engaged with pinion gears 143 and 144 respectively. The pinion gears 143 and 144 are coupled to motors M141 and M142 through a pulley and a belt, and the aligning members 141 and 142 are moved in the front-back direction by normally and reversely rotating the motors. Sensors (not illustrated) are provided in the aligning members 141 and 142 to detect home positions respectively, and usually the aligning members 141 and 142 stand by at the home positions.

In the embodiment, the home position of the front-side aligning member 141 is set to the front end portion, and the home position of the rear-side aligning member 142 is set to the rear end portion.

While the sheet bundle is nipped between the aligning members 141 and 142, the sheet bundle can be moved by moving the aligning members 141 and 142 in the same direction. Therefore, the aligning members 141 and 142 also act as a sheet bundle moving member as describes later.

(Swing Guide)

Figure 3:
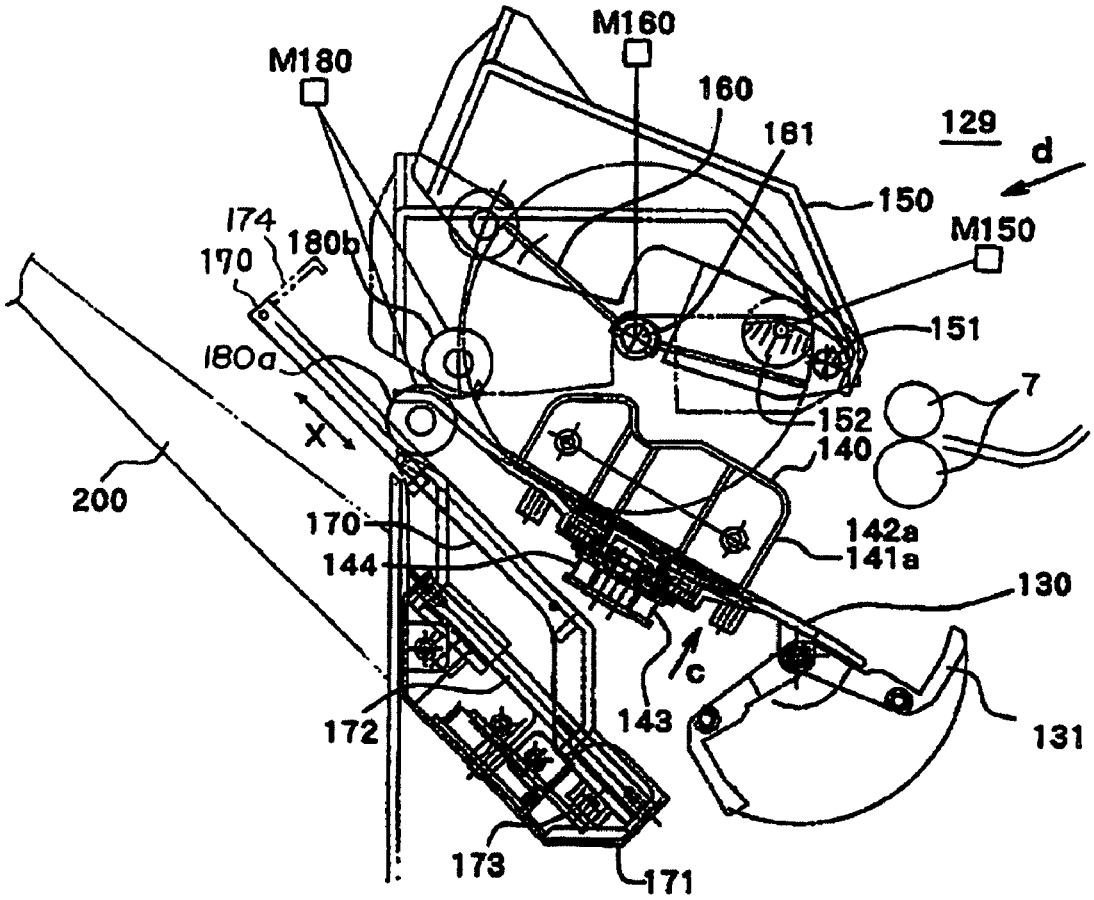
FIG. 3 is a front view illustrating an overall configuration of the sheet processing apparatus.

In the swing guide 150, the bundle discharge upper roller 180*b* is supported on the downstream side (left side of FIG. 3), and a swing supporting-point shaft 151 is provided on the upstream side (right side of FIG. 3). The swing guide 150 is in the opened state (bundle discharge roller pair 180 is separated from each other) when the sheet P is discharged one by one to the processing tray 130. The swing guide 150 does not become an obstacle, when the sheet is discharges to and falls on the processing tray 130, or when the alignment operation is performed. The swing guide 150 becomes the closed state (bundle discharge roller pair 180 abuts on each other) when the sheet bundle is discharged from the processing tray 130 to the stack tray 200.

A rotating cam 152 is provided at a position corresponding to the side face of the swing guide 150. When the rotating cam 152 is rotated to push up the side face of the guide, the swing guide 150 is opened while swung about the swing supporting-point shaft 151, and the swing guide 150 is closed when the rotating cam 152 is rotated by 180° from this state and separated from the side face of the swing guide. The rotating cam 152 is rotated by a swing motor M150 coupled thereto through a driving system (not illustrated).

The swing guide 150 is located at the home position when being in the closed state and a sensor (not illustrated) is provided to detect the home position.

(Staple Unit)

Figure 6:
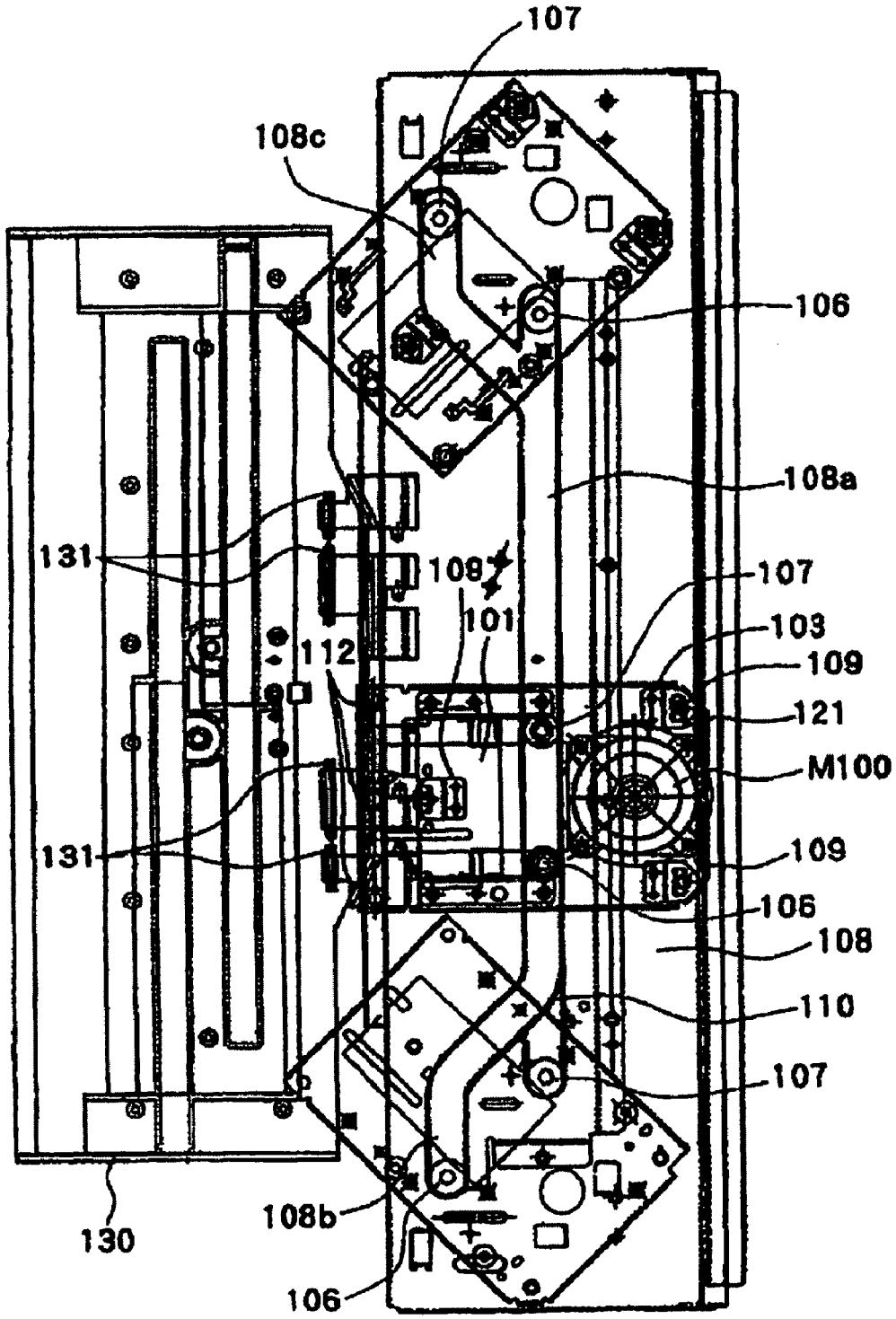
FIG. 6 is a plan view illustrating a stapler moving mechanism.
Figure 7:
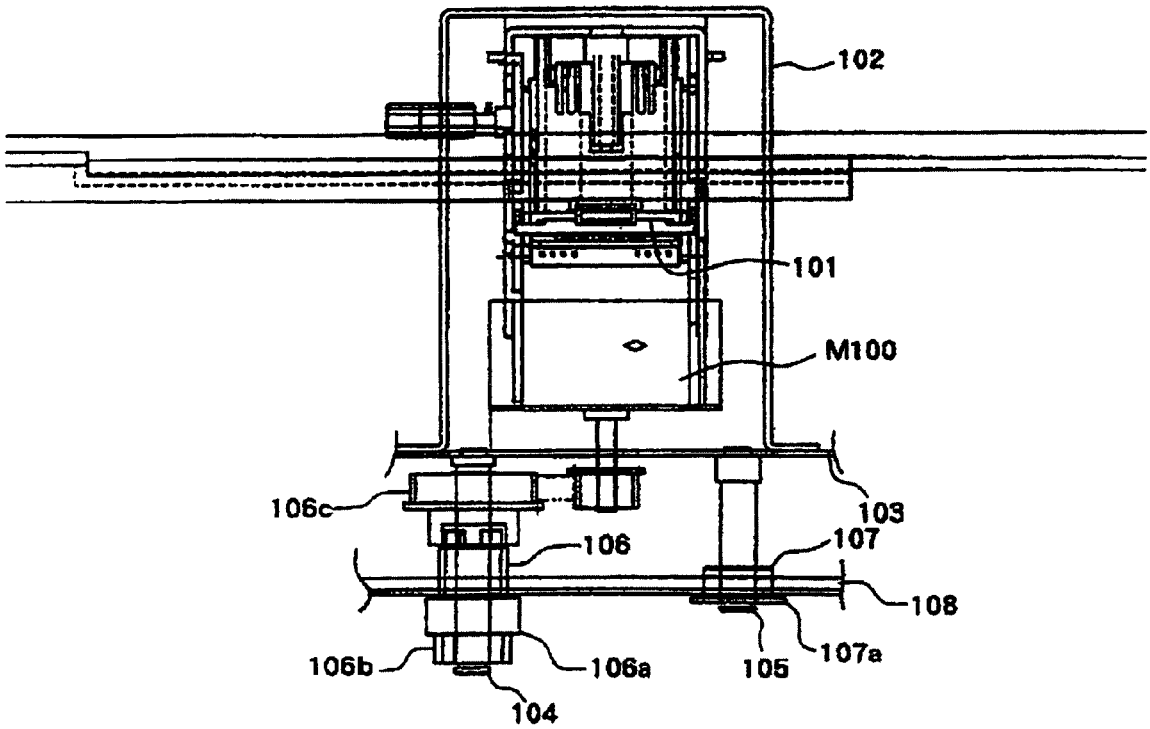
FIG. 7 is a rear view illustrating a stapler.

The staple unit 100 that staples the sheet bundle stacked on the processing tray 130 will be described with reference to FIGS. 6 and 7.

The stapler 101 is attached while being movable by a stapler moving device. The stapler moving device includes the stapler moving stage 103, shafts 104 and 105, rollers 106 and 107, and a fixed stage 108. The configuration of the stapler 101 will specifically described below. The stapler 101 is fixed to the stapler moving stage 103 with a holder 102 interposed therebetween. The rollers 106 and 107 are rotatably assembled in the shafts 104 and 105 fixed to the stapler moving stage 103, and the rollers 106 and 107 are fitted in rail holes 108*a*, 108*b*, and 108*c* made in the fixed stage 108.

The rollers 106 and 107 have flanges 106*a* and 107*a* that are larger than the rail holes of the fixed stage 108 respectively. On the other hand, support rollers are provided at three points below the stapler moving stage 103, and the stapler moving stage 103 supporting the stapler 101 can be moved on the fixed stage 108 along the rail holes 108*a*, 108*b*, and 108*c* without dropping off from the rail holes 108*a*, 108*b*, and 108*c*. The stapler moving stage 103 is moved on the fixed stage 108 by the roller 109 that is rotatably provided in the stapler moving stage 103.

The rail holes 108*a*, 108*b*, and 108*c* are branched on the way to form two parallel rails in the front and rear portions. Due to the rail shape, when the stapler 101 is located at the front portion (lower side of FIG. 6), the roller 106 is inclined toward the side of the rail hole 108*b* while fitted in the rail hole 108*b*, and the roller 107 is inclined toward the side of the rail hole 108*a* while fitted in the rail hole 108*a*. When the stapler 101 is located in the central portion, the rollers 106 and 107 are fitted in the rail holes 108*a* to become the horizontal state.

When the stapler 101 is located on the rear side (upper side of FIG. 6), the roller 106 is inclined toward the side of the rail hole 108*a* while fitted in the rail hole 108*a*, and the roller 107 is inclined toward the side of the rail hole 108*c* while fitted in the rail hole 108*c*. That is, the rollers 106 and 107 are inclined toward the opposite direction to the direction in which rollers 106 and 107 are inclined when the stapler 101 is located at the front portion.

After the rollers 106 and 107 are fitted in the two parallel rails, the rollers 106 and 107 are moved while the attitudes are held. The orientations of the rollers 106 and 107 are changed by a cam (not illustrated).

The moving mechanism of the stapler 101 will now be described. As illustrated in FIG. 7, in the roller 106 of the stapler moving stage 103, a pinion gear 106*b* and a belt pulley 106*c* are integrally formed. The pinion gear 106*b* is coupled to a stapler moving motor M100 through a belt entrained about the pulley 106*c*. The stapler moving motor M100 is fixed from above the stapler moving stage 103. On the other hand, the rack gear 110 is fixed along the rail hole to the lower surface of the fixed stage 108 so as to engage the pinion gear 106*b*, and the stapler moving stage 103 is moved in the front-back direction along with the stapler 101 by forward and reverse rotating the stapler moving motor M100.

The fall-down roller 112 (see FIG. 4) is provided in the shaft extended in the downward direction of the stapler moving stage 103, and the fall-down roller 112 turns the rear-end stopper 131 in order to prevent the rear-end stopper 131 of the processing tray 130 from colliding with the stapler 101.

In the staple unit 100, the sensor is provided to detect the home position of the stapler 101, and usually the stapler 101 stand by at the home position (front end portion in the embodiment).

(Control Block Diagram)

The control device 950 that control the whole of the image forming apparatus of the embodiment will be described below with reference to FIG. 8.

Figure 8:
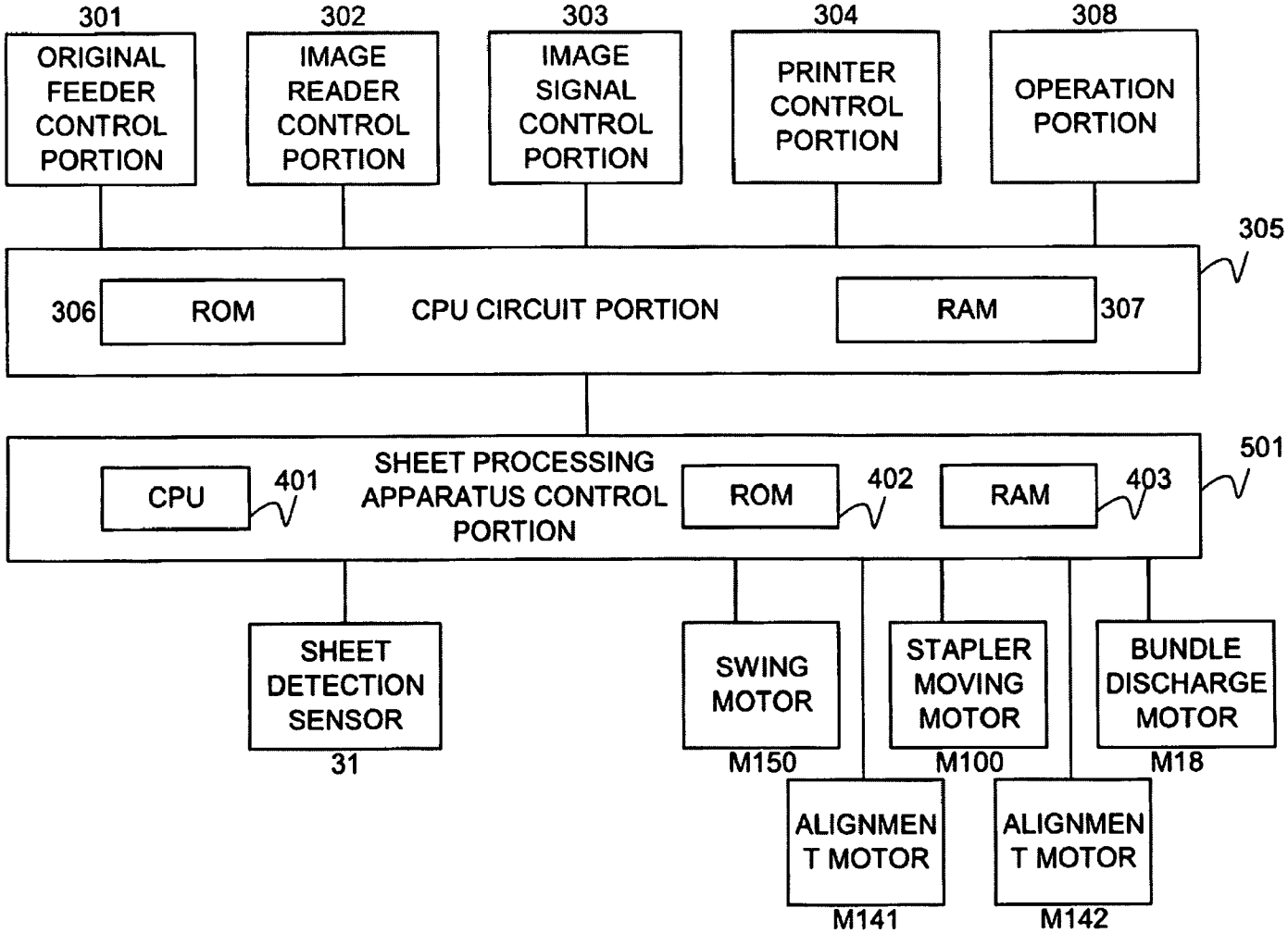
FIG. 8 illustrates a control block.

As illustrated in FIG. 8, the control device 950 is mounted on the image forming apparatus body 300, and the control device 950 includes a CPU circuit portion 305. A CPU (not illustrated), ROM 306, and RAM 307 are incorporated in the CPU circuit portion 305. An original feeder control portion 301, an image reader control portion 302, an image signal control portion 303, a printer control portion 304, an operation portion 308, and a sheet processing apparatus control portion 501 are controlled in the collective manner by a control program stored in ROM 306. RAM 307 is used to temporarily retain control data, and RAM 307 is also used to retain data as a work area for a computing process associated with the control.

The original feeder control portion 301 is a control portion which controls the drive of the automatic original feeder 500 (see FIG. 2) based on an instruction from the CPU circuit portion 305. The image reader control portion 302 controls the drive of the light source 907 and lens system 908, and the image reader control portion 302 transfers an RGB analog image signal outputted from the lens system 908 to the image signal control portion 303.

The image signal control portion 303 performs various processes after converting the RGB analog image signal from the lens system 908 into a digital signal, and the image signal control portion 303 converts the digital signal into a video signal to output the video signal to the printer control portion 304. The CPU circuit portion 305 controls the process operation performed by the image signal control portion 303.

The operation portion 308 includes plural keys that set various functions associated with the image formation and a display portion 308*a* (see FIG. 9) that displays information indicating the setting state. A key signal corresponding to each key operation of the operation portion 308 is supplied to the CPU circuit portion 305 that acts as the computation portion or the input portion. In the operation portion 308, the corresponding information is displayed based on the signal from the CPU circuit portion 305.

The sheet processing apparatus control portion 501 is mounted on the sheet processing apparatus 1, and the sheet processing apparatus control portion 501 conducts information data communication with the CPU circuit portion 305 on the image forming apparatus body side through a communication IC (not illustrated), whereby the sheet processing apparatus control portion 501 can control the drive of the whole of the sheet processing apparatus 1. The sheet processing apparatus control portion 501 also includes CPU 401, ROM 402, and RAM 403. Alternatively, the sheet processing apparatus control portion 501 may be integral with the control device 950 on the image forming apparatus body side to directly control the sheet processing apparatus 1 from the image forming apparatus body 300.

Various actuators and various sensors are controlled based on a control program stored in ROM 402. Specifically, the sheet processing apparatus control portion 501 controls the sheet detection sensor 31 that detects the sheet, the swing motor M150, the stapler moving motor M100, the alignment motors M141 and M142, and the bundle discharge motor M18. RAM 403 temporarily retains the control data or RAM 403 is used as the work area for the computation process associated with the control.

[Movement between Staple Positions]

In the sheet processing apparatus of the embodiment, the stapling process is performed to two points of the sheet bundle stacked on the processing tray 130. When the stapler 101 is moved to the next staple position, the sheet bundle on the processing tray 130 is moved in the opposite direction to the stapler moving direction while the stapler 101 is moved. At this point, when the weight of the sheet bundle is lower than a predetermined value, a moving speed of the sheet bundle is set faster than a moving speed at which the sheet bundle is moved when the weight of the sheet bundle is not lower than the predetermined value. The configuration will be described below.

(Sheet Weight Setting Method)

Figure 9:
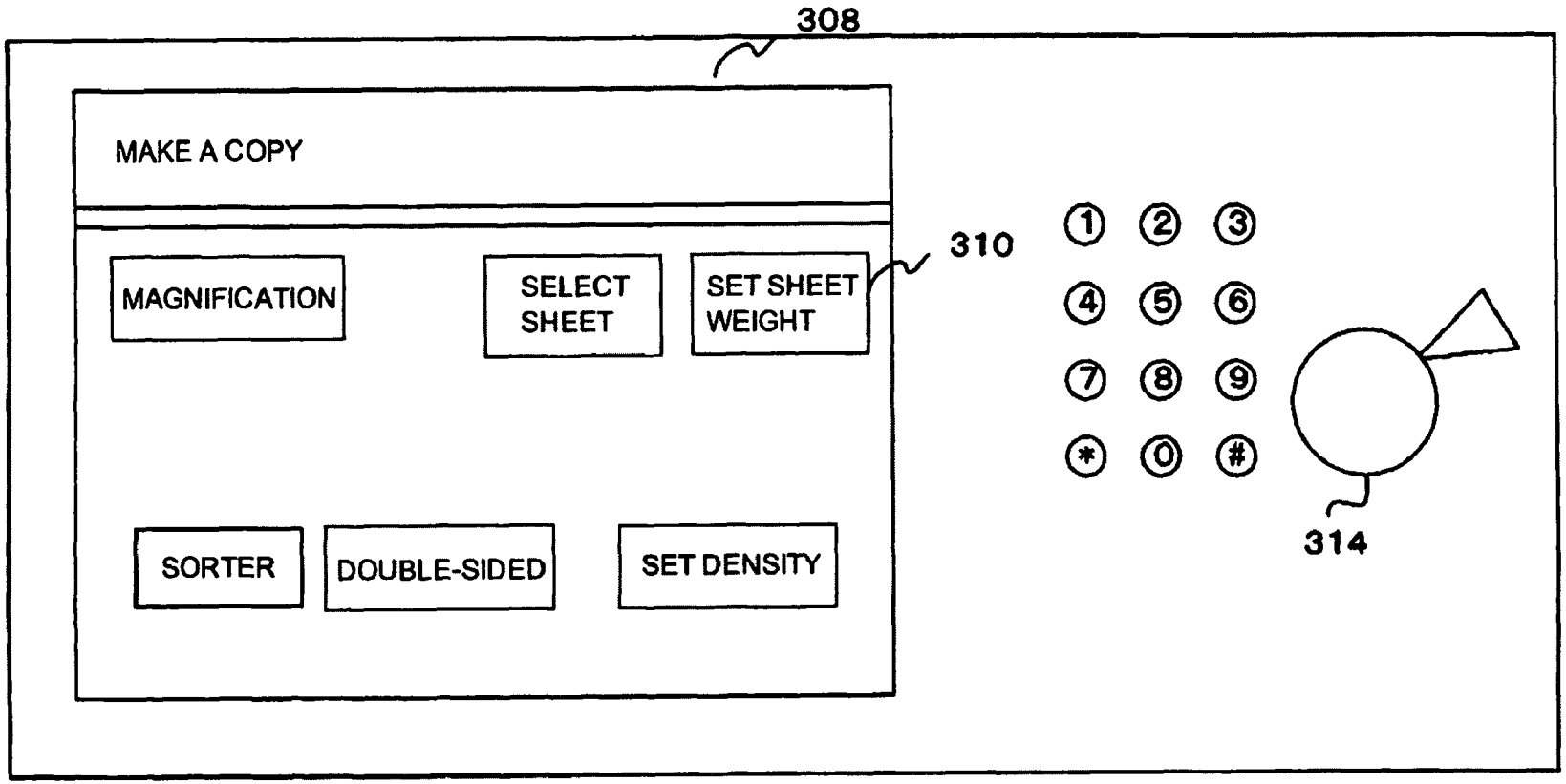
FIG. 9 illustrates an operation portion screen in a copy standby state.

In the embodiment, a sheet weight (grammage) is inputted from the operation portion 308 in order to determine the weight of the sheet bundle stacked on the processing tray 130. FIG. 9 illustrates the display state of the operation portion in the copy standby state. The operation portion 308 is formed by a touch panel. When a sheet weight setting button 310 is pressed down in the copy standby state, the operation screen of FIG. 10 can be changed to the sheet weight input screen.

The corresponding sheet weight button is selected from a button 311 in which the sheet weight is lower than 100 g/m$^2$, a button 312 in which the sheet weight is not lower than 100 g/m$^2$ and lower than 200 g/m$^2$, and a button 313 in which the sheet weight is not lower than 200 g/m$^2$, and the buttons 311, 312, and 313 are provided in each cassette. The sheet weight is inputted by pressing the corresponding sheet weight button.

Figure 10:
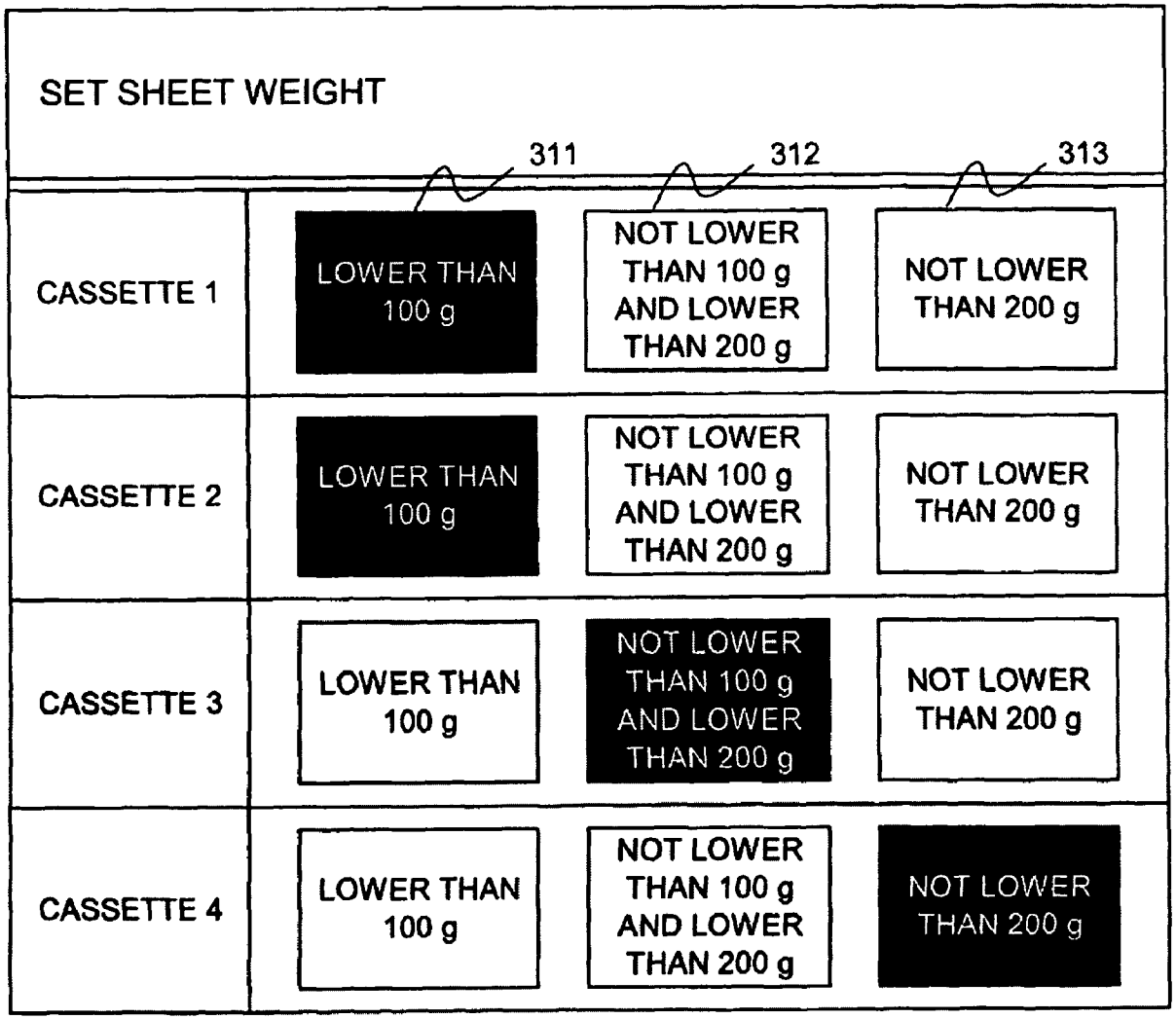
FIG. 10 illustrates a sheet weight setting screen of an operation portion.

Although FIG. 10 illustrates four cassettes, the number of cassettes may be changed as appropriate. In the embodiment, the weight setting is selected from the range lower than 100 g/m$^2$, the range that is not lower than 100 g/m$^2$ and lower than 200 g/m$^2$, and the range not lower than 200 g/m$^2$. Alternatively, the range of the selected weight may be changed, or the weight may be directly input.

(Setting of Method for Moving Stapler between Staple Positions)

The operation in which the stapler 101 is moved from the first staple position to the next staple position in the case of the two-point binding will be described below.

When the stapling process is performed to at least two points of the sheet bundle, the sheet processing apparatus of the embodiment has a first moving mode in which the stapler 101 and the sheet bundle on the processing tray 130 are moved in the opposite directions to each other and thereby moving the stapler 101 to the next staple position. Additionally, the sheet processing apparatus of the embodiment has a second moving mode in which only the stapler 101 is moved without moving the sheet bundle. The stapler 101 is moved by the stapler moving device and the sheet bundle is moved by moving the aligning members 141 and 142 that are of the sheet bundle moving member.

Figure 11:
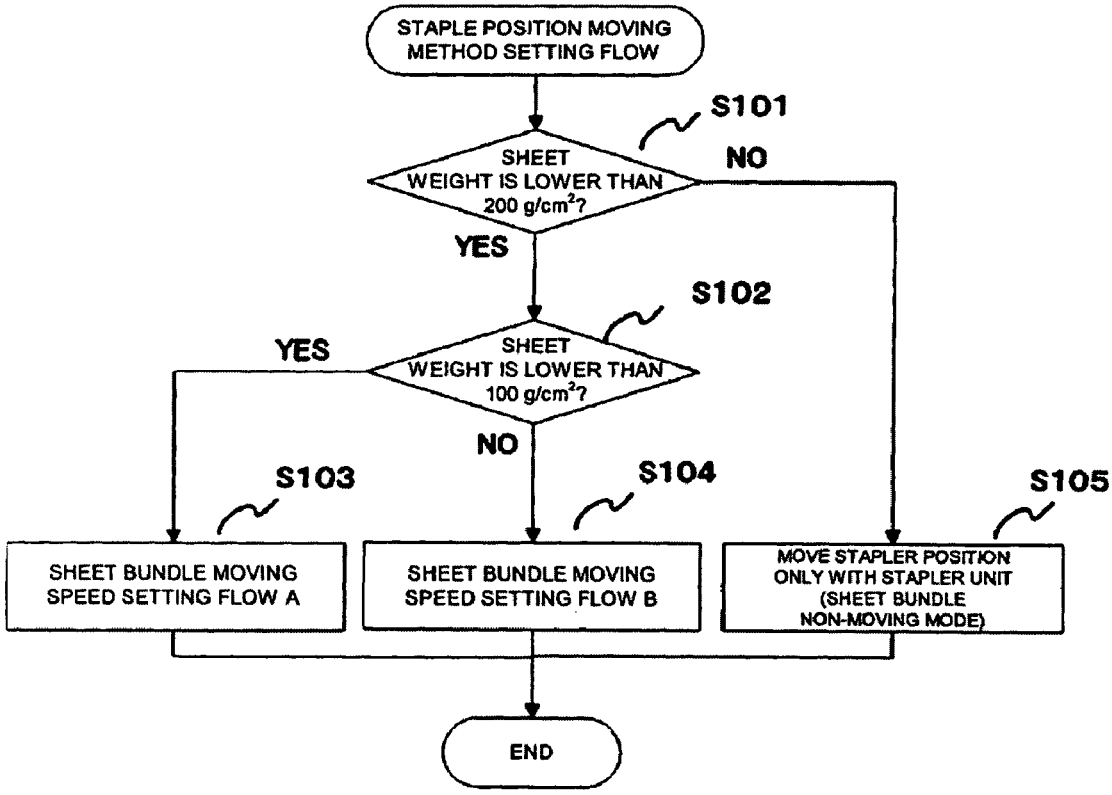
FIG. 11 illustrates a staple position moving method setting flow.

FIG. 11 illustrates a staple position moving method setting flow. The staple position moving method setting flow is performed immediately before the start key 314 is pressed to start the copy. A determination whether or not the sheet weight (grammage) inputted from the operation portion is lower than 200 g/m$^2$ is made in Step S101. When the sheet weight is not lower than 200 g/m$^2$ in Step S101, the second moving mode (sheet bundle non-moving mode) in which the stapler position is moved only by moving the stapler 101 is set. In the case where the sheet bundle has the extremely heavy weight, because the total weight of the sheet bundle is increased as the number of sheets constituting the sheet bundle is increased, it is necessary to enlarge the motor for driving the sheet bundle moving member that moves the sheet bundle according to the increased weight. Because the sheet bundle having the extremely heavy weight is rarely used, the relative movement is not performed for the sheet bundle having the extremely heavy weight in order to suppress the enlargement of the motor.

On the other hand, when the sheet weight is lower than 200 g/m$^2$ in Step S101, the first moving mode in which the stapler 101 and the sheet bundle on the processing tray 130 are moved in the opposite directions to each other is set. In the first moving mode, a determination whether or not the sheet weight is lower than 100 g/m$^2$ is made in Step S102. When the sheet weight is not lower than 100 g/m$^2$ in Step S102, a sheet bundle moving speed setting flow B in which the moving speed of the sheet bundle in moving the stapler 101 to the next staple position is performed in Step S104. On the other hand, when the sheet weight is lower than 100 g/m$^2$ in Step S102, a sheet bundle moving speed setting flow A is performed. Thus, the sheet weight is described as the grammage. Alternatively, the sheet weight may be determined by a sheet size.

Figure 12:
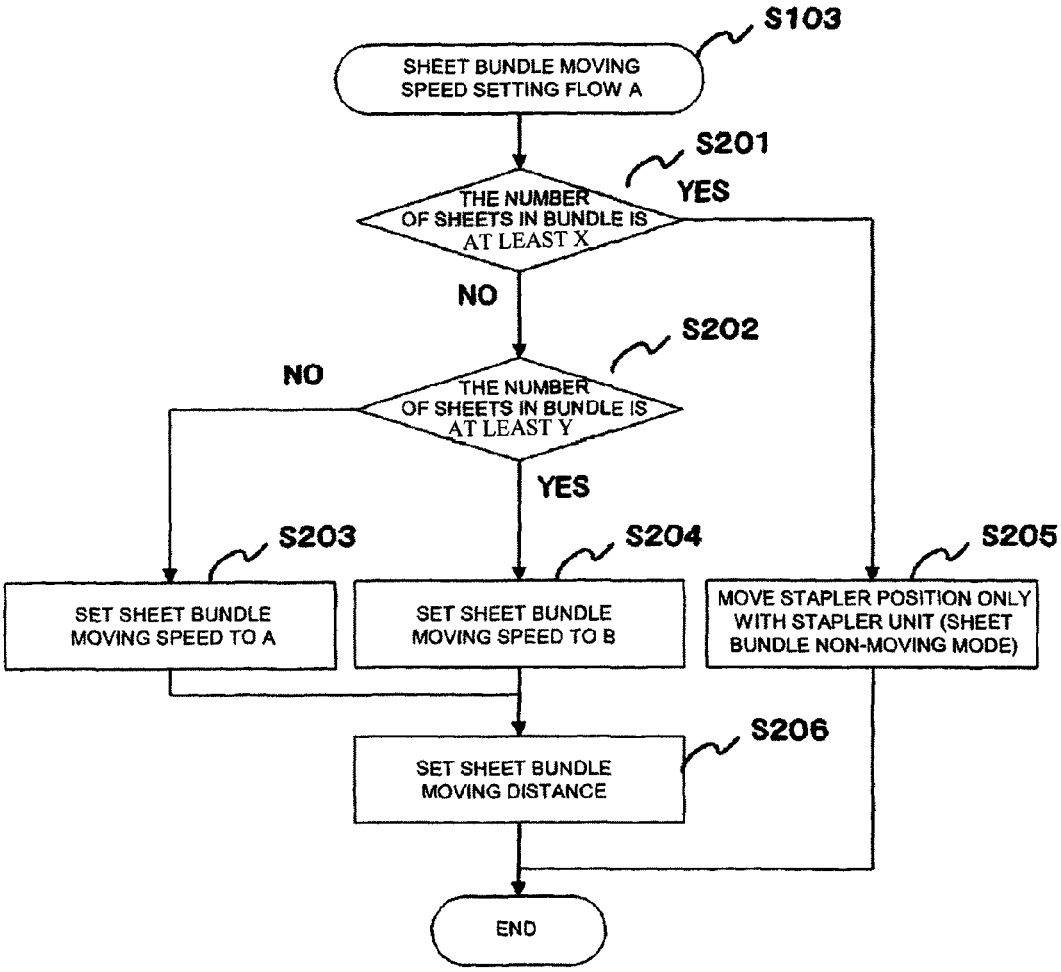
FIG. 12 illustrates a sheet bundle moving speed setting flow A.

The sheet bundle moving speed setting flow A in the case of the light sheet weight will be described with reference to FIG. 12.

A determination whether or not the number of sheet in the sheet bundle is not lower than the predetermined number of sheets X is made in Step S201. When the number of sheet in the sheet bundle is not lower than X in Step S201, the second moving mode in which the stapler position is moved only by moving the stapler 101 is set.

On the other hand, when the number of sheet in the sheet bundle is lower than X in Step S201, a determination whether or not the number of sheet in the sheet bundle is not lower than the number of sheets Y is made (Step S202). When the number of sheets in the sheet bundle is not lower than the number of sheets Y in Step S202, the moving speed of the sheet bundle in moving the stapler 101 to the next staple position is set to B (Step S204). On the other hand, when the number of sheets in the sheet bundle is lower than Y in Step S202, the moving speed of the sheet bundle in moving the stapler 101 to the next staple position is set to A that is faster than B (Step S203). Then, a sheet bundle moving distance M is computed in Step S206. The sheet bundle moving distance M is determined by the following equation. It is assumed that L mm is a distance to the next staple position and C is a moving speed of the stapler. In the embodiment, the moving speed of the stapler is kept constant.

In the case where the moving speed of the sheet bundle is set A, $$M=L/(A+C)\times A$$

In the case where the moving speed of the sheet bundle is set B, $$M=L/(B+C)\times B$$

The sheet bundle moving distance is set as described above, and the process is ended.

Figure 13:
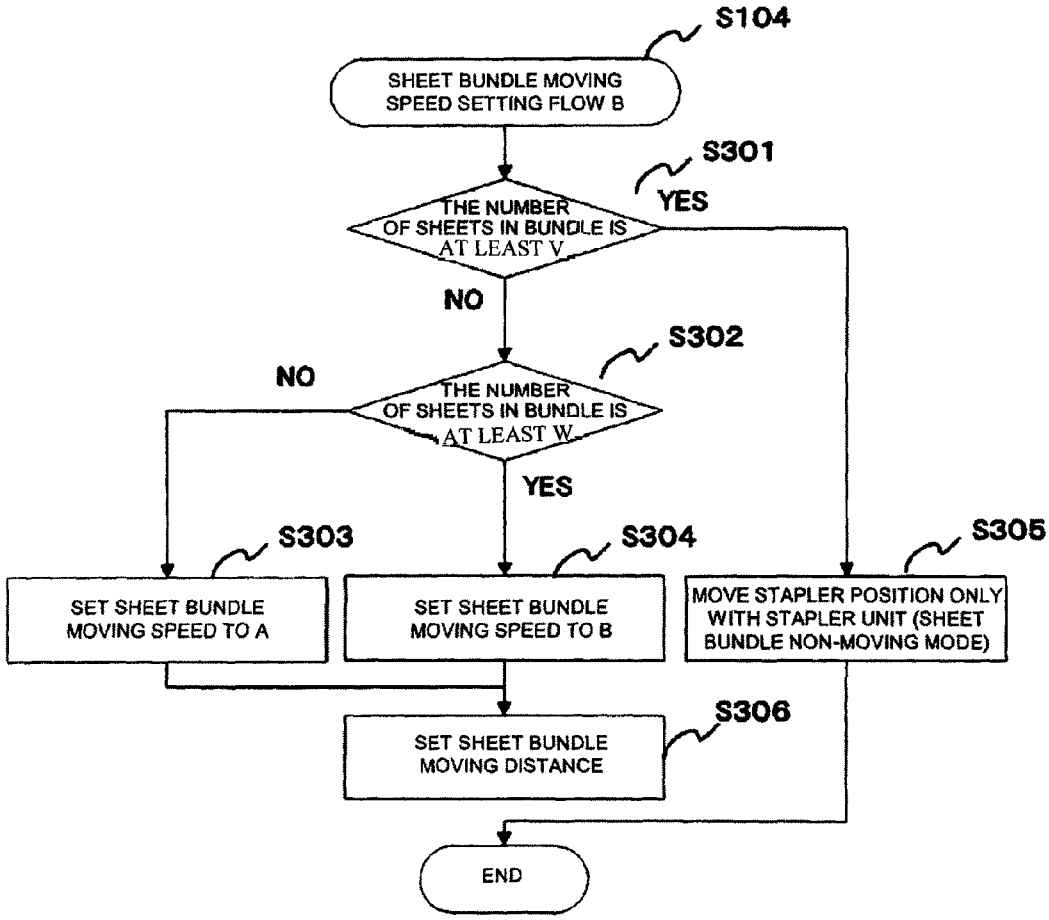
FIG. 13 illustrates a sheet bundle moving speed setting flow B.

FIG. 13 illustrates the sheet bundle moving speed setting flow B in the case of the heavy sheet weight. As illustrated in FIG. 13, the number of sheets in which the moving speed is switched is changed according to the sheet weight. That is, the switching control is performed in the terms of the sheet bundle weight determined by sheet weight×the number of sheets. In Step S301, when the number of sheets in the sheet bundle is not lower than the number of sheets V (lower than X), the second mode in which the stapler position is moved only by moving the stapler 101 is set.

On the other hand, when the number of sheets in the sheet bundle is lower than the number of sheets V in Step S301, a determination whether or not the number of sheet in the sheet bundle is not lower than the number of sheets W is made (Step S302). When the number of sheet in the sheet bundle is not lower than W in Step S302, the moving speed of the sheet bundle in moving the stapler 101 to the next staple position is set to B (Step S304). On the other hand, when the number of sheet in the sheet bundle is lower than W in Step S302, the moving speed of the sheet bundle in moving the stapler 101 to the next staple position is set to A that is faster than B (Step S303). In Step S306, similarly to the setting flow A, the sheet bundle moving distance M is computed.

Thus, the determination whether or not the sheet bundle weight is not lower than the predetermined value can be made based on whether or not the number of sheets in the sheet bundle stacked on the stack tray 200 is not lower than the predetermined number of sheets. When the number of sheets in the sheet bundle stacked on the stack tray 200 is lower than the predetermined number of sheets, the moving speed of the sheet bundle is set faster than the moving speed at which the sheet bundle is moved when the sheet bundle weight is not lower than the predetermined value. When the moving speed of the sheet bundle is set faster, the moving distance of the sheet bundle relatively becomes longer. In the embodiment, because moving speed of the stapler is kept constant, the stapling process time is shortened by increasing a ratio of the sheet bundle movement in the staple position movement.

(Staple Position Moving Operation)

Then, the stapling process operation in which the sheet bundle and stapler are relatively moved will be described. The two-point binding is performed on the conditions of the sheet bundle moving speed of 200 mm/s, the sheet bundle moving distance of 48 mm, the stapler moving speed of 300 mm/s, and the stapling interval of 120 mm.

First offset-less stacking in which the sheet is always discharged to the same position of the stack tray will be described.

Figure 14A:
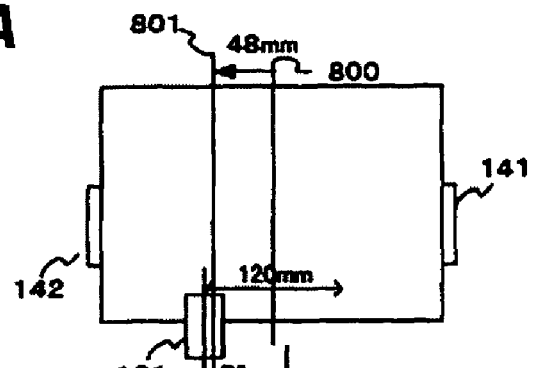
FIG. 14 illustrates a sheet bundle on the processing tray.

FIG. 14A illustrates the state immediately before the sheet bundle is stacked on the processing tray 130 to perform the stapling to the first point. The numeral 801 designates a sheet center position when the sheet is discharged to the stack tray, and the numeral 800 designates a sheet center.

As illustrated in FIG. 14A, the sheet bundle is aligned at the position that is shifted rightward by the sheet bundle moving distance with respect to the position where the sheet bundle is discharged to the stack tray. Then, the staple binding is performed, the stapler is moved rightward by 72 mm, and the sheet bundle is moved leftward by 48 mm, thereby moving the stapler to the next staple position.

Figure 14B:
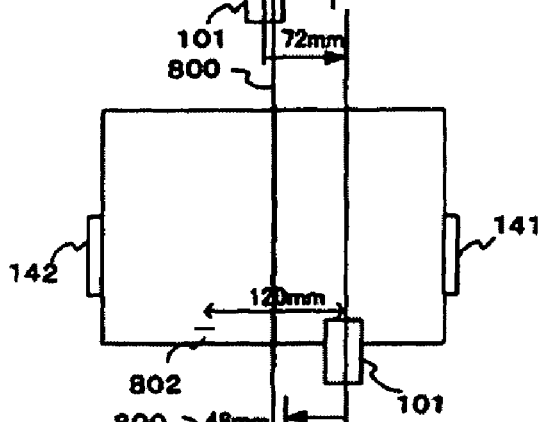

FIG. 14B illustrates the state in which the stapler is moved to the second staple position. The numeral 802 designates a staple needle. As can be seen from FIG. 14B, the sheet center position 801 and the sheet center 800 overlap each other when the sheet bundle is discharged to the stack tray. Thus, the sheet bundle is aligned at the previously-shifted position in consideration of the sheet bundle movement, which allows the sheet bundle to be discharged at any position on the stack tray.

Figure 14C:
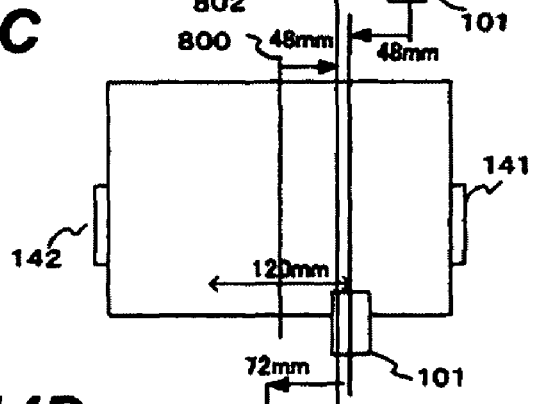

FIG. 14C illustrates the state immediately before the stapling is performed to the first point of the next sheet bundle. As illustrated in FIG. 14C, the sheet bundle is aligned at the position that is shifted leftward by the sheet bundle moving distance with respect to the position where the sheet bundle is discharged to the stack tray. The stapler standby position is also set in the right. The stapler standby position and the sheet bundle alignment position are alternately set for the first point. Then, the staple binding is performed, the stapler is moved leftward by 72 mm, and the sheet bundle is moved rightward by 48 mm, thereby moving the stapler to the next staple position.

Figure 14D:
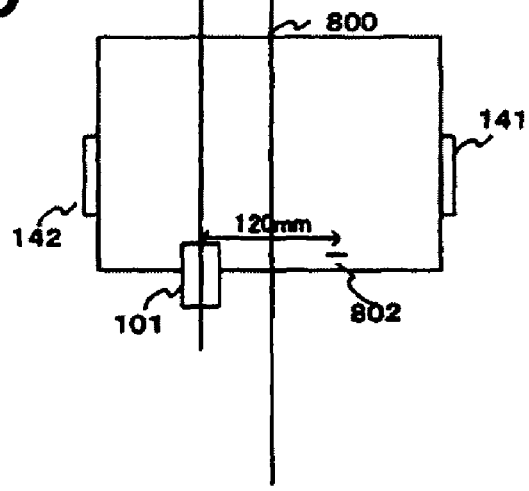

FIG. 14D illustrates the state in which the stapler is moved to the second staple position of the next sheet bundle. The numeral 802 designates a staple needle. As can be seen from FIG. 14D, the sheet center position 801 and the sheet center 800 overlap each other when the sheet bundle is discharged to the stack tray. Thus, the sheet bundle is aligned at the previously-shifted position in consideration of the sheet bundle movement, which allows the sheet bundle to be discharged at any position on the stack tray. Then, the stapler is moved to the position illustrated in FIG. 14A again. The sheet bundle can be discharged at any position on the stack tray by repeating the operation.

In the case of the second moving mode (sheet bundle non-moving mode) in which the stapler position is moved only by moving the stapler, the sheet bundle is aligned at the position where the sheet bundle is discharged onto the stack tray, and the stapler 101 stands by at the first staple position. Then, the stapling is performed to the first staple position, only the stapler 101 is moved after the stapling is ended, and the stapler 101 is stopped at the second staple position.

(Staple Mode Operation)

Figure 15:
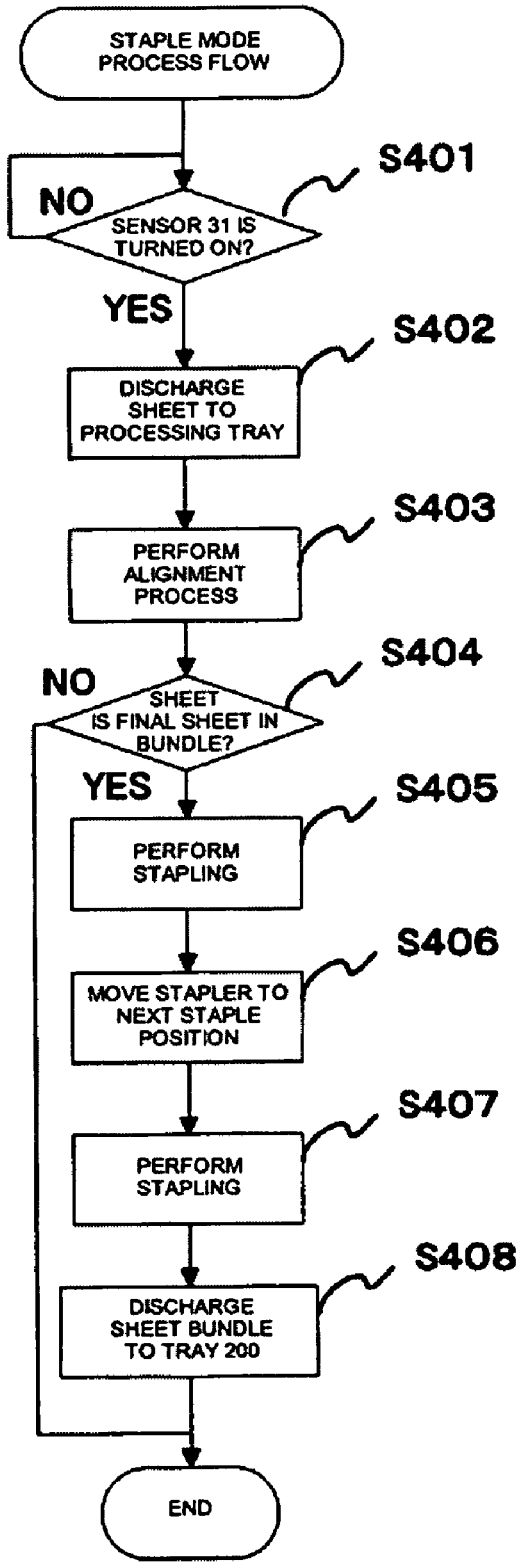
FIG. 15 illustrates a staple mode process flow.

The operation of the two-point binding will be described with reference to a staple mode process flow of FIG. 15. The staple mode process flow is performed after the start key 314 is pressed. The staple mode process flow is performed in each sheet.

A determination whether or not the sheet detection sensor 31 is turned on is made in Step S401. The process in Step S401 is repeatedly performed until the sensor is turned on. When sheet detection sensor 31 is turned on in Step S401, the sheet is discharged to the processing tray 130 (Step S402), and the sheet is aligned at a predetermined position by the aligning members 141 and 142 (Step S403). A determination whether or not the aligned sheet is the final sheet of the bundle is made in Step S404 (Step S404). When the sheet is not the final sheet in Step S404, the staple mode process flow is ended. On the other hand, when the sheet is the final sheet in Step S404, the stapling is performed to the sheet bundle (Step S405). Then, the stapler is moved to the next staple position by the method determined by staple position moving setting method (Step S406). The stapling is performed to the second staple position (Step S407), the sheet bundle is discharged to the stack tray 200 (Step S408), and the staple mode process flow is ended.

[Experimental Result]

The experiment results is illustrated while the process of the embodiment in which the staple position is moved by the sheet bundle movement and the stapler movement is compared to the process in which the staple position is moved only by the stapler movement.

Figure 16:
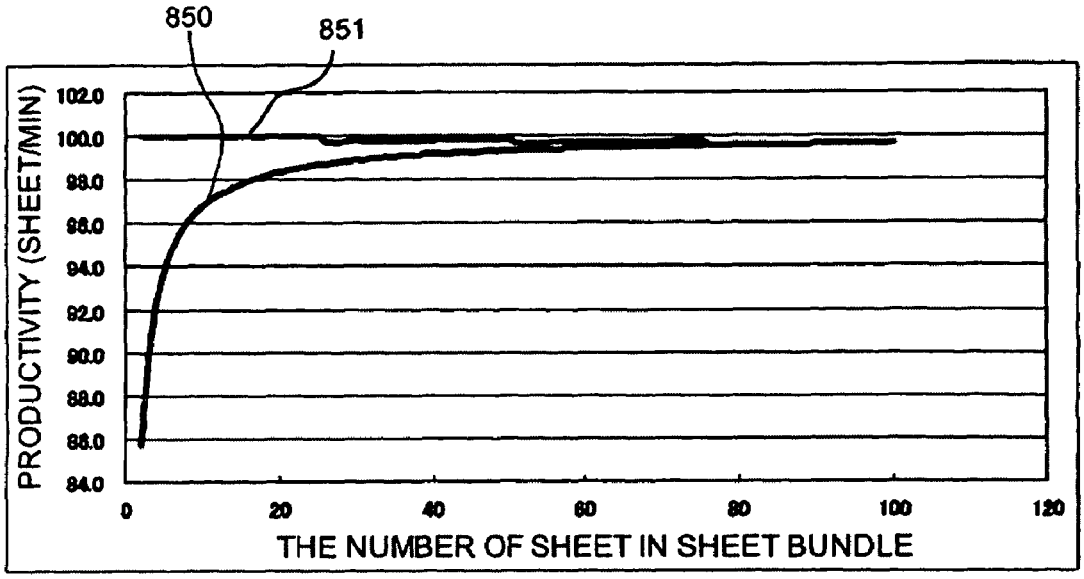
FIG. 16 illustrates an effect of productivity improvement of the invention.

In FIG. 16, a vertical axis indicates productivity (the number of sheets per minute) and a horizontal axis indicates the number of sheet in the sheet bundle. A curve 850 indicates a transition of the productivity for the number of sheet in the sheet bundle when the staple position is moved only by the stapler movement. A curve 851 indicates a transition of the productivity for the number of sheet in the sheet bundle when the staple position is moved by the sheet bundle movement and the stapler movement.

The comparison is performed on the following conditions by way of example. However, a degree of improvement of the productivity depends on the conditions.

(1) productivity of image forming apparatus: 100 sheets per minute (2) time interval lengthened between sheet bundles in stapling process time: 0.2 second (3) stapling interval between first and second staple positions: 120 mm (4) stapler moving speed: 300 mm/s (5) alignment speed: 2 to 25 sheets: 300 mm/s, 26 to 50 sheets: 200 mm/s, 51 to 75 sheets: 100 mm/s, and 76 to 100 sheets: only stapler is moved As can be seen from FIG. 16, in comparison of the curve 850 and the curve 851, the productivity in the small number of sheets is improved when the staple position is moved by the sheet bundle movement and the stapler movement. Thus, in the embodiment, the productivity in the small number of sheets can be improved without enlarging the motor for moving the sheet bundle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-136435, filed May 23, 2007, and No. 2008-114822, filed Apr. 25, 2008, which is hereby incorporated by reference herein in its entirety.

What is claimed is:

1. A sheet processing apparatus comprising:

a sheet stacking portion on which a sheet bundle is stacked;

a sheet bundle moving portion which moves the sheet bundle stacked on the sheet stacking portion;

a stapler which performs a stapling process at a plurality of staple positions of the sheet bundle stacked on the sheet stacking portion;

a stapler moving device which moves the stapler; and a controller which controls the sheet bundle moving portion and the stapler moving device to perform the stapling process at the plurality of staple positions of the sheet bundle by a movement of the stapler and the sheet bundle, the controller controls the sheet bundle moving portion and the stapler moving device so that a moving speed of the sheet bundle at which a number of sheets in the sheet bundle to be moved by the sheet bundle moving portion is lower than a predetermined number value or a weight of the sheet bundle to be moved by the sheet bundle moving portion is lower than a predetermined weight value is set faster than a moving speed of the sheet bundle at which the number of sheets in the sheet bundle to be moved by the sheet bundle moving portion is not lower than the predetermined number value or the weight of the sheet bundle to be moved by the sheet bundle moving portion is not lower than the predetermined weight value.

2. The sheet processing apparatus according to claim 1 wherein when the movement between the staple positions is performed by the movement of the stapler and the sheet bundle, the controller controls the sheet bundle moving portion and the stapler moving device so that the stapler and the sheet bundle are moved in the opposite directions.

3. The sheet processing apparatus according to claim 1, wherein the controller controls the stapler moving device so that a moving speed of the stapler is constant irrespective of the number of sheets in the sheet bundle or the weight of the sheet bundle.

4. A sheet processing apparatus comprising:

a sheet stacking portion on which a sheet bundle is stacked;

a sheet bundle moving portion which moves the sheet bundle stacked on the sheet stacking portion;

a stapler which performs a stapling process at a plurality of staple positions of the sheet bundle stacked on the sheet stacking portion;

a stapler moving device which moves the stapler; and a controller which controls the sheet bundle moving portion and the stapler moving device to perform the stapling process at the plurality of staple positions of the sheet bundle, the controller controls the sheet bundle moving portion and the stapler moving device so that when a number of sheets in the sheet bundle to be moved by the sheet bundle moving portion is lower than a predetermined number value, or when a weight of the sheet bundle to be moved by the sheet bundle moving portion is lower than a predetermined weight value, the movement between the staple positions is performed by both movements of the stapler and the sheet bundle, and when the number of sheets in the sheet bundle to be moved by the sheet bundle moving portion is not lower than the predetermined number value, or when the weight of the sheet bundle to be moved by the sheet bundle moving portion is not lower than the predetermined weight value, the movement between the staple positions is performed only by the stapler.

5. The sheet processing apparatus according to claim 1 wherein when the movement between the staple positions is performed by the movement of the stapler and the sheet bundle, the controller controls the sheet bundle moving portion and the stapler moving device so that the stapler and the sheet bundle are moved in the opposite directions.

6. The sheet processing apparatus according to claim 4, wherein the controller controls the stapler moving device so that a moving speed of the stapler is constant irrespective of the number of sheets in the sheet bundle or the weight of the sheet bundle.

7. The image forming apparatus according to claim 4, wherein the controller controls the stapler moving device so that a moving speed of the stapler is constant irrespective of the number of sheets in the sheet bundle or the weight of the sheet bundle.

8. An image forming apparatus comprising:

an image forming portion which forms an image on a sheet; and a sheet processing apparatus which processes the sheet on which the image is formed, the sheet processing apparatus includes:

a sheet stacking portion on which a sheet bundle is stacked;

a sheet bundle moving portion which moves the sheet bundle stacked on the sheet stacking portion;

a stapler which performs of staple positions of the sheet bundle stacked on the sheet stacking portion;

a stapler moving device which moves the stapler; and a controller which controls the sheet bundle moving portion and the stapler moving device to perform the stapling process at the plurality of staple positions of the sheet bundle by a movement of the stapler and the sheet bundle, the controller controls the sheet bundle moving portion and the stapler moving device so that the moving speed of the sheet bundle, at which a number of sheets in the sheet bundle to be moved by the sheet bundle moving portion is lower than a predetermined number value or a weight of the sheet bundle to be moved by the sheet bundle moving portion is lower than a predetermined weight value is set faster than a moving speed of the sheet bundle at which the number of sheets in the sheet bundle to be moved by the sheet bundle moving portion is not lower than the predetermined number value or the weight of the sheet bundle to be moved by the sheet bundle moving portion is not lower than the predetermined weight value.

9. The image forming apparatus according to claim 8, wherein when the movement between the staple positions is performed by the movement of the stapler and the sheet bundle, the control portion controls the sheet bundle moving portion and the stapler moving device so that the stapler and the sheet bundle are moved in the opposite directions.

10. An image forming apparatus comprising:

an image forming portion which forms an image on a sheet; and a sheet processing apparatus which processes the sheet on which the image is formed, the sheet processing apparatus includes:

a sheet stacking portion on which a sheet bundle is stacked;

a sheet bundle moving portion which moves the sheet bundle stacked on the sheet stacking portion;

a stapler which performs a stapling process at a plurality of staple positions of the sheet bundle stacked on the sheet stacking portion;

a stapler moving device which moves the stapler; and a controller which controls the sheet bundle moving portion and the stapler moving device to perform the stapling process at the plurality of staple positions, the controller controls the sheet bundle moving portion and the stapler moving device so that when a number of sheets in the sheet bundle to be moved by the sheet bundle moving is lower than a predetermined number value or when a weight of the sheet bundle to be moved by the sheet bundle moving portion is lower than a predetermined weight value, the movement between the staple positions is performed by both movements of the stapler and the sheet bundle, and when the number of sheets in the sheet bundle to be moved by the sheet bundle moving portion is not lower than the predetermined value or when a weight of the sheet bundle to be moved by the sheet bundle moving portion is not lower than the predetermined weight value, the movement between the staple positions is performed only by the stapler.

11. The image forming apparatus according to claim 10, wherein the controller controls the stapler moving device so that a moving speed of the stapler is constant irrespective of the number of sheets in the sheet bundle or the weight of the sheet bundle.

12. The image forming apparatus according to claim 10, wherein when the movement between the staple positions is performed by both movement of the stapler and the sheet bundle, the controller controls the sheet bundle moving portion and the stapler moving device so that the stapler and the sheet bundle are moved in the opposite directions.

* * * * *